US011162046B2

(12) United States Patent
Kamei et al.

(10) Patent No.: US 11,162,046 B2
(45) Date of Patent: Nov. 2, 2021

(54) LUBRICATING OIL COMPOSITION FOR AUTOMATIC TRANSMISSION

(71) Applicant: SHELL OIL COMPANY, Houston, TX (US)

(72) Inventors: Genki Kamei, Tokyo (JP); Ryuji Maruyama, Aikoh-Gun (JP); Shinji Saitou, Tokyo (JP); Shouhei Harada, Tokyo (JP)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 16/617,196

(22) PCT Filed: May 25, 2018

(86) PCT No.: PCT/EP2018/063828
§ 371 (c)(1),
(2) Date: Nov. 26, 2019

(87) PCT Pub. No.: WO2018/219827
PCT Pub. Date: Dec. 6, 2018

(65) Prior Publication Data

US 2021/0130726 A1 May 6, 2021

(30) Foreign Application Priority Data

May 30, 2017 (JP) ..... JP2017-106637

(51) Int. Cl.

| | |
|---|---|
| ***C10M 111/04*** | (2006.01) |
| ***C10M 101/00*** | (2006.01) |
| *C10N 30/00* | (2006.01) |
| *C10N 40/04* | (2006.01) |
| *C10N 20/02* | (2006.01) |
| *C10N 30/02* | (2006.01) |

(52) U.S. Cl.
CPC ..... *C10M 111/04* (2013.01); *C10M 101/00* (2013.01); *C10M 2205/0225* (2013.01); *C10M 2205/0285* (2013.01); *C10M 2205/173* (2013.01); *C10N 2020/02* (2013.01); *C10N 2030/02* (2013.01); *C10N 2030/36* (2020.05); *C10N 2030/54* (2020.05); *C10N 2030/68* (2020.05); *C10N 2030/74* (2020.05); *C10N 2040/042* (2020.05)

(58) Field of Classification Search
CPC ..... C10M 2205/173; C10M 111/04; C10M 101/00; C10M 2205/0225; C10N 2030/74; C10N 2030/68; C10N 2030/54; C10N 2030/36; C10N 2040/042; C10N 2020/02; C10N 2030/02
See application file for complete search history.

(56) References Cited

U.S. PATENT DOCUMENTS

| | | | | |
|---|---|---|---|---|
| 5,691,281 | A * | 11/1997 | Ashjian | C07C 5/2518 507/103 |
| 6,713,438 | B1 * | 3/2004 | Baillargeon | C10M 143/12 508/463 |
| 10,227,541 | B2 | 3/2019 | Masuda et al. | |
| 2004/0154958 | A1 * | 8/2004 | Alexander | C10M 109/02 208/18 |
| 2004/0224860 | A1 | 11/2004 | Baba et al. | |
| 2006/0052252 | A1 * | 3/2006 | Wedlock | C10M 171/02 508/110 |
| 2006/0205610 | A1 * | 9/2006 | Rosenbaum | C10M 169/04 508/110 |

(Continued)

FOREIGN PATENT DOCUMENTS

| | | | |
|---|---|---|---|
| EP | 2333036 | A1 | 6/2011 |
| JP | 2009096925 | A | 5/2009 |

(Continued)

OTHER PUBLICATIONS

International Search Report and Written Opinion received for PCT Patent Application No. PCT/EP2018/063828, dated Jul. 4, 2018, 09 pages.

Fujita et al., "Lubricant Composition for Automatic Transmission Comprises Poly-alpha-olefin Manufactured Using Metallocene Catalyst", Database WPI / 2017 Clarivate Analytics, Issue No. 43, Accession No. 2011-H03643, Jun. 23, 2011, XP002782328.

(Continued)

*Primary Examiner* — Ellen M Mcavoy

(74) *Attorney, Agent, or Firm* — Shell Oil Company

(57) ABSTRACT

This invention provides a lubricating oil composition for automobile transmission that includes: as low-viscosity base oils: (i) between 45 and 95 mass % of a Fischer-Tropsch synthetic low-viscosity base oil with a 100° C. kinematic viscosity of between 1 $mm^2/s$ and 2 $mm^2/s$, and between 0 and 25 mass % of other than a Fischer-Tropsch synthetic low-viscosity base oil with a 100° C. kinematic viscosity of between 1 $mm^2/s$ and 2 $mm^2/s$, and (ii) between 0 and 35 mass % of a base oil wherein the 100° C. kinematic viscosity is greater that 2 $mm^2/s$ and no greater than 5 $mm^2/s$; and (iii) between 5 and 55 mass % of an olefin polymer or copolymer, as a high-viscosity base oil, wherein the 100° C. kinematic viscosity is between 100 and 800 $mm^2/s$. A lubricating oil composition for an automatic transmission wherein the 100° C. kinematic viscosity of this composition is between 3.8 and 5.5 $mm^2/s$, the viscosity index is no less than 190, the flashpoint is no less than 140° C., and the reduction ratio of the 100° C. kinematic viscosity after shear stability testing, at 60° C. for 20 hours, is maintained at no greater than 3%.

12 Claims, No Drawings

(56) References Cited

U.S. PATENT DOCUMENTS

| | | | | |
|---|---|---|---|---|
| 2014/0011724 | A1* | 1/2014 | Onumata | C10M 145/14 508/469 |
| 2015/0024979 | A1* | 1/2015 | Southby | C10M 107/02 508/110 |
| 2015/0275130 | A1* | 10/2015 | Willars | C10M 169/047 508/161 |
| 2016/0257904 | A1* | 9/2016 | Mayernick | C10M 169/041 |
| 2017/0009180 | A1* | 1/2017 | Chen | C10M 169/041 |
| 2017/0226443 | A1* | 8/2017 | Shinoda | C10M 171/00 |
| 2017/0253827 | A1* | 9/2017 | Abe | C10M 107/06 |
| 2018/0100119 | A1* | 4/2018 | Aoyama | C10M 145/14 |
| 2019/0024004 | A1* | 1/2019 | Kuroda | C10M 101/02 |
| 2019/0112541 | A1* | 4/2019 | Hamachi | C10M 107/02 |
| 2019/0276764 | A1* | 9/2019 | Maruyama | C10M 169/041 |
| 2019/0338212 | A1* | 11/2019 | Abe | C10M 143/04 |
| 2020/0263105 | A1* | 8/2020 | Kamei | C10M 107/02 |

FOREIGN PATENT DOCUMENTS

| | | | |
|---|---|---|---|
| JP | 2011121991 | A | 6/2011 |
| WO | 2016050700 | A1 | 4/2016 |

OTHER PUBLICATIONS

Zhao et al., "The Performance and Application of High Grade Lubricating Base Oil are Described", Oilmen Skill, Issue No. 1, 2003, 6 pages.

Zhuang, "Petroleum Additive", Progress in fine Petrochemical Industry, Issue No. 8, 8 pages.

Office Action Received for Chinese Application No. 201880034103.6, dated Jul. 1, 2021, 12Pages (06 Pages of English Translation and 06 Pages of Official Copy).

* cited by examiner

LUBRICATING OIL COMPOSITION FOR AUTOMATIC TRANSMISSION

CROSS REFERENCE TO EARLIER APPLICATION

The present application is the National Stage (§ 371) of International Application No. PCT/EP2018/063828, filed May 25, 2018, which claims priority from Japanese Application 2017-106637, filed May 30, 2017 incorporated herein by reference.

FIELD OF THE INVENTION

The present invention relates to a lubricating oil composition that is suitable for use in an automatic transmission.

BACKGROUND OF THE INVENTION

In lubricating oils, and in particular in automatic transmission fluids, there is the need for lubricating oils that can be used in automatic transmissions, including torque converters, wet clutches, gear bearing mechanisms, and hydraulic mechanisms, and that are provided with a good balance of a variety of functions such as being a medium for transmitting force, lubricating gears and the like, a medium for conducting heat, maintaining prescribed friction characteristics, and the like.

In these types of automatic transmissions, it is necessary to not only achieve a reduction in mechanical shock when changing gears, but also necessary to adjust the viscosity of the lubricating oil and to adjust friction in order to achieve a good torque transfer function and to reduce energy loss.

For such adjustments of the lubricating oil, a mineral oil that has relatively low viscosity with respect to the base oil is used, and polyacryl methacrylate is used therein as a viscosity index improving agent, to adjust the viscosity of the composition as a whole, as described in Japanese Unexamined Patent Application Publication 2009-96925.

The present inventors are attempting to produce a lubricating oil that is suitable for use over a broad temperature range and that is able to improve fuel economy as well, as a lubricating oil for an automatic transmission that has a high viscosity index at a low viscosity, that has superior viscosity characteristics at low temperatures, that has good shear stability, and that also has little evaporation at high temperatures, and has a high flashpoint.

SUMMARY OF THE INVENTION

The present invention is a lubricating oil composition for an automatic transmission including: as low-viscosity base oils: (i) between 45 and 95 mass % of a Fischer-Tropsch synthetic low-viscosity base oil with a 100° C. kinematic viscosity of between 1 $mm^2/s$ and 2 $mm^2/s$, and between 0 and 25 mass % of other than a Fischer-Tropsch synthetic low-viscosity base oil with a 100° C. kinematic viscosity of between 1 $mm^2/s$ and 2 $mm^2/s$, and (ii) between 0 and 35 mass % of a base oil wherein the 100° C. kinematic viscosity is greater than 2 $mm^2/s$ and no greater than 5 $mm^2/s$; and (iii) between 5 and 55 mass % of an olefin (co)polymer, as a high-viscosity base oil, wherein the 100° C. kinematic viscosity is between 100 and 800 $mm^2/s$, wherein: the 100° C. kinematic viscosity of the composition is between 3.8 and 5.5 $mm^2/s$, the viscosity index is no less than 190, the flashpoint is no less than 140° C., and the reduction ratio in the 100° C. kinematic viscosity after KRL shear stability testing (60° C. for 20 hours) is maintained in a range of no greater than 3%.

DETAILED DESCRIPTION OF THE INVENTION

The lubricating oil composition according to the present invention has a high viscosity index at low viscosities, superior viscosity characteristics at low temperatures, and good shear stability. Moreover, it can be used as a lubricating oil composition that has little evaporation at high temperatures and that has remarkably improved oxidation stability while maintaining friction characteristics, has little variation in kinematic viscosity in change in the viscosity index even when there is a high temperature oxidation, and has a high flashpoint as well, and is provided with a good balance of a variety of functions such as that of a medium for transmitting power, a lubricant for gears, and the like, a medium for conducting heat, preservation of prescribed friction characteristics, and the like. Consequently, it is well suited for use as a lubricant oil composition for an automatic transmission, for superior fuel economy, and superior durability as well, that can be used over an extended period of time while always maintaining an identical state.

Moreover, this lubricant composition can be used effectively broadly in, for example, transmission fluids such as gear oils, AT fluids, MT fluids, CVT fluids, and the like, for automobiles, and in industrial lubricating oils as well such as industrial gear oils, hydraulic fluids, compressor fluids, and the like.

That which is used as the low-viscosity base oil (i), described above, is a GTL (gas-to-liquid) low-viscosity base oil synthesized through the Fisher-Tropsch method, which is a technology for making liquid fuel out of a natural gas, where, when compared to a mineral oil base oil that is refined out of crude oil, this GTL low-viscosity base oil has an extremely low sulfur content and aromatic component content, with an extremely high paraffin structure proportion, and thus is superior in terms of oxidation stability, has a high flashpoint, with extremely little evaporative loss, and thus is well suited as the base oil for the present invention. Moreover, when compared to other low-viscosity base oils, the aniline point is high, and the effect on rubber seal members is low as well.

In this GTL low-viscosity base oil, the 100° C. kinematic viscosity is no less than 1 $mm^2/s$ and no greater than 2 $mm^2/s$, and preferably no less than 1.1 $mm^2/s$ and no greater than 1.9 $mm^2/s$, and more preferably no less than 1.2 $mm^2/s$ and no greater than 1.8 $mm^2/s$. If the 100° C. kinematic viscosity were less than 1 $mm^2/s$, that the evaporation would be significant, with the possibility that it would not be possible to ensure an adequate oil quantity, even in equipment that is tightly sealed, and if in excess of 2 $mm^2/s$, there would be the possibility that the viscosity could be too high at low temperatures, with increased stirring resistance. Moreover, normally the total sulfur content is less than 1 ppm and the total nitrogen content is also less than 1 ppm.

The aniline point of these base oils is no less than 90° C. and no greater than 110° C., and more preferably no less that 95° C. and no greater than 107° C., and the refractive index is no less than 1.42 and no greater than 1.46, and more preferably no less than 1.43 and no greater than 1.45. Examples of such GTL low-viscosity base oils include Shell GTL Solvent GS310, and the like.

The GTL low-viscosity base oil described above may be used so as to have between 45 and 95 mass %, and preferably between 45 and 85 mass %, where if 45 mass % or below, problems would occur in the attributes of viscosity index, low-temperature fluidity, and shear stability, which could prevent the desired effects.

A base oil other than a Fisch-Tropsch synthetic low-viscosity base oil that has a 100° C. kinematic viscosity of between 1 $mm^2/s$ and 2 $mm^2/s$ may be added in a range of between 0 and 25 mass %, if necessary, in a range that does not cause a loss of performance of the GTL low-viscosity base oil described above, and may be, for example, a polyalphaolefin (PAO), which is a synthetic hydrocarbon base oil. The upper limit for the amount added is 25 mass %, and preferably is no greater than 22 mass %. If more than 25 mass %, this would reduce the proportion of inclusion of the Fisher-Tropsch synthetic low-viscosity base oil, which could prevent adequate performance from being achieved.

Moreover, as a low-viscosity base oil, (ii) a base oil with a 100° C. kinematic viscosity in excess of 2 $mm^2/s$ and no greater than 5 $mm^2/s$ may be used in conjunction, at a proportion of between 0 and 35 mass %. A base oil of the group 2 or group 3, in the API (American Petroleum Institute) base oil classifications, which has low-viscosity, may be used for such a base oil. Moreover, a polyalphaolefin (PAO) belonging to the group 4 may be used in conjunction.

An olefin (co)polymer may be used as the high-viscosity base oil (iii). This olefin copolymer may be specifically an ethylene-alpha olefin copolymer, a polyalphaolefin (PAO), or the like, where the 100° C. kinematic viscosity is between 100 and 800 $mm^2/s$, where between 200 and 700 $mm^2/s$ is preferred, and between 300 and 600 $mm^2/s$ is more preferred.

With a 100° C. kinematic viscosity that is no less than 100 $mm^2/s$, an effect of improving the viscosity index of the lubricating oil composition produced will be seen, and, on the other hand, at no greater than 800 $mm^2/s$, the shear stability of the lubricating oil composition produced will be good.

From the perspective of applying an effect of improving the viscosity index and applying a good shear stability, this high-viscosity base oil is used in a proportion between 5 and 55 mass %, and preferably between 8 and 35 mass %, and more preferably between 11 and 30 mass %, and in this composition, can apply an appropriate viscosity at high temperatures. If the amount were less than the lower limit, there would be a tendency for the effect on improving the viscosity index to be inadequate, and, conversely, if in excess of the upper limit, there would be the danger of the viscosity being too high at low temperatures, which could have a negative effect on suitability.

In such a lubricating oil composition, the 100° C. kinematic viscosity is set to between 3.8 and 5.5 $mm^2/s$, and preferably between 4.1 and 5.3 $mm^2/s$, and more preferably to between 4.5 and 5.2 $mm^2/s$.

If the viscosity were lower than this, it would be difficult to maintain an oil film at a high temperature, and, conversely, if the viscosity were higher than this, the stirring resistance would be increased, which would have a negative effect on fuel economy.

It is necessary for the viscosity index to be no less than 190, and preferably no less than 195, and more preferably no less than 200. If lower than this, the viscosity would be high at low temperatures, increasing the stirring resistance, and there would be an increased risk of increased wear through difficulty in maintaining an oil film at high temperatures.

It is necessary for the flashpoint to be no less than 140° C., and preferably no less than 160° C. If less than this, the amount of evaporation would be high, making stable use difficult.

Moreover, in a KRL shear stability test, measured under conditions of 60° C. for 20 hours, the 100° C. kinematic viscosity reduction ratio after testing must be no greater than 3.0%, preferably no greater than 2.0%, and more preferably no greater than 1.0%. If this shear stability were poor, the reduction in viscosity of the composition would be too high, and would have a negative effect on the ability to maintain an oil film at high temperatures.

While the use of a low-viscosity base oil is effective in achieving a high viscosity index, if the low-viscosity base oil has attributes that are similar to those of fuel, the evaporation would be significant, with the concern that it might not be possible to ensure an adequate amount of oil, even in tightly sealed equipment. The composition must be no greater than 50% in an evaluation of the amount of NOACK evaporation, and preferably no greater than 45%, and even more preferably no greater than 30%.

Moreover, the 0° C. kinematic viscosity should be no greater than 120 $mm^2/s$. Preferably it is no greater than 110 $mm^2/s$, and even more preferably no greater that 100 $mm^2/s$. If the viscosity were higher than this, the stirring resistance would be increased, which would have a negative effect in use in lubricating at low temperatures or when used in cold climates.

It can be anticipated that there would be an adverse effect on seal members if the amount of evaporation of the composition were relatively high, making it impossible to preserve the sealing performance, enabling the oil fraction to escape as time elapses, making it impossible to ensure enough oil for lubrication. Consequently, the rubber durability characteristics must be such that the volume change ratio is not negative and so that an adequate mechanical strength is maintained, and preferably the elongation change ratio at breaking is no greater than (minus) 50%. Typically, this seal member is an acryl or nitrile rubber, and it should be noted that nitrile is more susceptible to an adverse effect from the base oil component than acryl.

If necessary, known additives such as, for example, extreme pressure agents, dispersing agents, metal-based cleaning agents, friction adjusting agents, oxidation inhibitors, corrosion inhibitors, rust inhibitors, anti-emulsifying agents, metal deactivating agents, pour point depressing agents, seal swelling agents, anti-foaming agents, coloring agents, and various other types of additives, either singly or in combinations of several types, may be mixed into the transmission lubricating oil composition according to the present invention.

In this case, usually a commercially available automatic transmission additive package is used.

EXAMPLES

While the automatic transmission lubricating oil composition according to the present invention will be explained in detail using Examples and reference examples, the present invention is in no way limited thereto.

The following materials were prepared for manufacturing Examples and reference examples.

1. Base Oils (i) Low-Viscosity Base Oil (with a 100° C. kinematic viscosity of between 1 and 2 $mm^2/s$)

A-1: GTL (gas-to-liquid) low-viscosity base oil (synthesizing method: Shell Middle Distillate Synthesis) (Attributes: 40° C. kinematic viscosity of 5.4 $m^2/s$, 100° C. kinematic viscosity of 1.8 $mm^2/s$, 15° C. density of 0.796, initial boiling point of 310° C., end point of 355° C., flashpoint of 174° C., aniline point of 105° C., 20° C. refractive index of 1.44, 20° C. surface tension of 29 mN/m, total sulfur content of less than 1 ppm, and total nitrogen content of less than 1 ppm)

A-2: GTL (gas-to-liquid) low-viscosity base oil (synthesizing method: Shell Middle Distillate Synthesis) (Attributes: 40° C. kinematic viscosity of 3.3 $m^2/s$, 100° C. kinematic viscosity of 1.3 $mm^2/s$, 15° C. density of 0.785, initial boiling point of 274° C., end point of 305° C., flashpoint of 150° C., aniline point of 97° C., 20° C. refractive index of 1.44, 20° C. surface tension of 29 mN/m, total sulfur content of less than 1 ppm, and total nitrogen content of less than 1 ppm)

B-1: PAO (Polyalphaolefin) (base oil other than the GTL low-viscosity base oil) (Attributes: 40° C. kinematic viscosity of 5.2 $mm^2/s$, 100° C. kinematic viscosity of 1.7 $mm^2/s$, 15° C. density of 0.798, flashpoint of 166° C., aniline point of 103° C., and 20° C. refractive index of 1.44)

B-2: Solvent (Isoparaffin-Based Hydrocarbon) (base oil other than GTL low-viscosity base oil) (Attributes: 40° C. kinematic viscosity of 2.5 $mm^2/s$, 100° C. kinematic viscosity of 1.0 $mm^2/s$, 15° C. density of 0.798, and flashpoint of 92° C.)

(ii) Low-viscosity Base Oil (with a 100° C. kinematic viscosity in excess of 2 $mm^2/s$ and no greater that 5 $mm^2/s$)

C-1: GTL (Gas-to-Liquid) Base Oil (Attributes: 40° C. kinematic viscosity of 9.7 $mm^2/s$, 100° C. kinematic viscosity of 2.7 $mm^2/s$, 15° C. density of 0.808, flashpoint of 200° C., aniline point of 113° C., and 20° C. refractive index of 1.45)

C-2: Mineral Oil (Group 3) (Attributes: 40° C. kinematic viscosity of 8.1 $mm^2/s$, 100° C. kinematic viscosity of 2.3 $mm^2/s$, 15° C. density of 0.823, flashpoint of 156° C., aniline point of 101° C., and 20° C. refractive index of 1.46)

(iii) High-Viscosity Base Oil

D-1: Ethylene-Alphaolefin Copolymer (Attributes: 100° C. kinematic viscosity of 40 $mm^2/s$) ("Lucant HC40," manufactured by Mitsui Chemicals)

D-2: Ethylene-Alphaolefin Copolymer (Attributes: 100° C. kinematic viscosity of 600 $mm^2/s$) ("Lucant HC600," manufactured by Mitsui Chemicals)

D-3: mPAO (Metallocene•Polyalphaolefin) (Attributes: 100° C. kinematic viscosity of 65 $mm^2/s$) ("Elite65," manufactured by Exxon Mobil Chemical)

D-4: mPAO (Metallocene•Polyalphaolefin) (Attributes: 100° C. kinematic viscosity of 150 $mm^2/s$) ("Elite150," manufactured by Exxon Mobil Chemical)

D-5: mPAO (Metallocene•Polyalphaolefin) (Attributes: 100° C. kinematic viscosity of 300 $mm^2/s$) ("Elite300," manufactured by Exxon Mobil Chemical)

D-6: Mineral Oil (Group 1) (Attributes: 40° C. kinematic viscosity of 490 $mm^2/s$, 100° C. kinematic viscosity of 32.7 $mm^2/s$)

2. Additives (iv) Viscosity Index Improving Agent

E-1: Polymethacrylate (Weight average molecular weight of 78,000) dissolved in mineral oil. When measured using GPC, the proportion of the peak area of the polymer component to the peak area of the mineral oil is 47:53. The GPC measurement conditions are as follows.

Measurement through GPC:

The mass average molecular weight was calculated using JIS K7252-1 "Method for Calculating Average Molecular Weight and Molecular Weight Distribution of Polymers Using Plastic-Size Removal Chromatography, Part 1: General Rules."

Apparatus used: Shodex GPC-101

Detector: Differential refractive index detector (RI)

Columns: KF-G (Shodex)×1, KF-805L (Shodex)×2

Measurement temperature: 40° C.

Carrier solvent: THF

Carrier flow rate: 0.8 mL/min (Ref: 0.3 mL/min) Standard reference material: Shodex STANDARD (Polystyrene)

$Mp=2.0\times10^3$ $Mp=5.0\times10^3$ $Mp=1.01\times10^4$ $Mp=2.95\times10^4$ $Mp=9.60\times10^4$ $Mp=2.05\times10^5$ Standard curve: Cubic Sample density: Approximately 2 mass %

Sample injection volume: 50 μL

The fraction that peaks with a retention time of about 17 minutes is the polymer component, and the fraction that peaks at about 22 minutes is the mineral oil fraction.

(v) Additive Package

F-1: Commercially available ATF additive package: Package with performance corresponding to DEXRON6, used in passenger vehicle automatic transmissions (not including a viscosity index improving agent)

The Examples and reference examples listed below were manufactured.

Example 1

80.3 mass % of the low-viscosity base oil (A-1), described above, and 10.7 mass % of the high-viscosity base oil (D-2) were used and mixed, and 9.0 mass % of the additive (F-1) was added thereto and thoroughly mixed, to produce the lubricating oil composition of the first Example.

Examples 2 Through 8

The lubricating oil compositions of Examples 2 through 8 were produced through the compositions described in Table 1 and Table 2, with the balance being based on the first Example.

Note that in Example 5, Example 6, and Example 8, the 100° C. kinematic viscosities of the low-viscosity base oil mixture were 1.56 $mm^2/s$ for Example 5, 2.1 $mm^2/s$ for Example 6, and 1.79 $mm^2/s$ for Example 8.

Reference Examples 1 Through 8

The lubricating oil compositions of Reference Examples 1 through 8 were produced through the compositions described in Table 3 and Table 4, with the balance being based on the first Example.

Testing

The following tests were performed as appropriate in order to know the attributes and performance of the Examples and reference examples described above.

40° C. Kinematic Viscosity

The 40° C. kinematic viscosities ($mm^2/s$) were measured based on JIS K2283.

Evaluation Standard: 10 to 30 $mm^2/s$: "Good" (O)

100° C. Kinematic Viscosity

The 100° C. kinematic viscosities ($mm^2/s$) were measured based on JIS K2283.

Evaluation Standard:

3.8 to no greater than 5.5 $mm^2/s$: "Good" (O) Less than 3.8 or greater than 5.5 $mm^2/s$: "Defective" (X)

0° C. Kinematic Viscosity

The 0° C. kinematic viscosities ($mm^2/s$) were measured based on JIS K2283.

Evaluation Standard: No greater than 120 $mm^2/s$: "Good" (O)

Greater than 120 $mm^2/s$: "Defective" (X)

Viscosity Index

Calculated based on JIS K2283.

Evaluation Standard: No less than 190: "Good" (O)

Less than 190: "Defective" (X)

KRL Shear Stability Test

Processing was carried out based on CEC-L-45-A-99 at 60° C. for 20 hours, the post-processing 100° C. kinematic viscosity was measured, and the reduction ratio (%) of the viscosity after processing, relative to prior to processing, for the 100° C. kinematic viscosity was calculated Evaluation standard: 100° C. kinematic viscosity reduction ratio no greater than 3.0%: "Good" (O) 100° C. kinematic viscosity reduction ratio greater than 3.0%: "Defective" (X)

NOACK Evaporation Tests

Testing was carried out based on ASTM D5800. That is, the ratio of reduction of the mass (mass %) after thermal breakdown by heating at 200° C. for one hour was measured.

Evaluation Standard: No greater than 50 mass %: "Good" (O)

Greater than 50 mass %: "Defective" (X)

Friction Coefficient, Through a Traction Tester

The testing used the traction measurement mode of an EHD tester manufactured by PCS Corporation to measure the friction coefficient under conditions of an oil temperature of 120° C., a load of 20 N, a speed of 0.17 m/s, with a slip rolling rate of 50%.

Rubber Durability Characteristics Tests

In the testing, a No. 3 dumbbell piece made from nitrile rubber was immersed into the lubricating oil compositions of Example 3 and Reference Example 3 and held for 140 hours at 150° C., and the following measurements were carried out for the states before and after immersion.

(1) Change in Hardness

The hardnesses were measured for five samples each, using a type A Durometer, and the median values were expressed as integers.

(2) Change in Tensile Strength

Three samples each were measured (Mpa) using an Instron tester, and the median strength change ratios (%) were calculated.

(3) Change Elongation at Breaking

The elongation ratios (%) at breaking were measured for 3 samples each using an Instron tester, to find the median changes in elongation ratios (%).

(4) Change in Volume

The amount of increase in volume (ml) was measured for 3 samples each, to find the volume change ratios (%) thereof.

Because in automatic transmission lubricating oil compositions use base oils that have low kinematic viscosities, the compositions evaporate easily and have an effect on the rubber seal members, such as the packings in the machinery, and rubber durability characteristic testing was carried out to learn about these effects.

Results

The results of the tests described above are shown in Table 1 through Table 4. In these tables, the places that are left blank are those wherein tests were omitted due to results from other tests. The results of the tests described above are shown in Table 1 through Table 4. In these tables, the places that are left blank are those wherein tests were omitted due to results from other tests.

Observations

In Example 1, the GTL low-viscosity base oil of the low-viscosity base oil (A-1), and the ethylene-alphaolefin copolymer of the high-viscosity base oil (D-2) were used, and good results were achieved with a 100° C. kinematic viscosity of 4.996 $mm^2/s$, a viscosity index of 207, a flashpoint of 172° C., a KRL shear stability test 100° C. kinematic viscosity reduction ratio of 0.2%, and a 0° C. kinematic viscosity of 100.6 $mm^2/s$.

In Examples 2 through 4, the GTL low-viscosity base oil of the low-viscosity base oil (A-1), and the mPAO's of the high-viscosity base oils (D-4) and (D-5) were used, and the results were all good for the 100° C. kinematic viscosity, the viscosity index, the flashpoint, the KRL shear stability test 100° C. kinematic viscosity reduction ratio, and the 0° C. kinematic viscosity.

In Example 5, the GTL low-viscosity base oil of the low-viscosity base oil (A-1) and the GTL low-viscosity base oil of (A-2) were mixed (where the 100° C. kinematic viscosity of the mixture was 1.56 $mm^2/s$), and this mixture and the mPAO of the high-viscosity base oil (D-5) were used, and the results were all good for the 100° C. kinematic viscosity, the viscosity index, the flashpoint, the KRL shear stability test 100° C. kinematic viscosity reduction ratio, and the 0° C. kinematic viscosity.

In Example 6, the GTL base oil of (C-1) was used instead of the GTL low-viscosity base oil of (A-2) in Example 5 (where the 100° C. kinematic viscosity of the mixture was 2.1 $mm^2/s$), and, similarly, the results were all good for the 100° C. kinematic viscosity, the viscosity index, the flashpoint, the KRL shear stability test 100° C. kinematic viscosity reduction ratio, and the 0° C. kinematic viscosity.

In Example 7, the GTL low-viscosity base oil of the low-viscosity base oil (A-1), and the ethylene-alphaolefin copolymer of the high-viscosity base oil (D-2) and the mPAO of (D-5) were used together, and the results were passing for the 100° C. kinematic viscosity, the viscosity index, the flashpoint, the KRL shear stability test 100° C. kinematic viscosity reduction ratio, and the 0° C. kinematic viscosity.

In Example 8, the GTL low-viscosity base oil of the low-viscosity base oil (A-1) and the PAO of (B1) were mixed at a ratio of approximately 2.7:1 (where the 100° C. kinematic viscosity of the mixture was 1.79 $mm^2/s$), and this mixture and the mPAO of the high-viscosity base oil (D-5) were used, and the results were all good for the 100° C. kinematic viscosity, the viscosity index, the flashpoint, the KRL shear stability test 100° C. kinematic viscosity reduction ratio, and the 0° C. kinematic viscosity.

In Reference Example 1, the GTL base oil of the low-viscosity base oil (C-1) and the mPAO of the high-viscosity base oil (D-5) were used, and the viscosity index was low, at 173, and the 0° C. kinematic viscosity was high at 128.7 $mm^2/s$, so the results were not good. In Reference Example 2, the mineral oil (group 3) of the low-viscosity base oil (C-2) and the mPAO of the high-viscosity base oil (D-5) were used, so the viscosity index and the 0° C. kinematic viscosity failed.

In reference example 3, the PAO of the low-viscosity base oil (B-1) and the mPAO of the high-viscosity base oil (D-5) were used, and the viscosity index, the 40° C. kinematic viscosity, the 100° C. kinematic viscosity, the 0° C. kinematic viscosity, the flashpoint, and the NOACK evaporation all were passing. However, in the rubber durability attribute testing, while essentially no difference was seen in the change in hardness, the tensile strength change ratio, and the volume change ratio, when compared to Example 3, a large difference was seen in the change in elongation ratio at breaking, so it was concluded that the GTL low-viscosity base oil was superior to the PAO base oil as a low-viscosity base oil.

In Reference Example 4, the isoparaffin-based hydrocarbon solvent of the low-viscosity base oil (B-2) and the mPAO of the high-viscosity base oil (D-5) were used, and good results were not produced, with the flashpoint being low and the evaporation in the NOACK test also being too high.

In Reference Example 5, that which had a 100° C. kinematic viscosity that was low, at 40 $mm^2/s$, of (D-1) was used as the high-viscosity base oil in the GTL low-viscosity base oil of the low-viscosity base oil (A-1), and thus the viscosity index was low and the 0° C. kinematic viscosity also did not pass.

In Reference Example 6, that wherein the 100° C. kinematic viscosity was low, at 65 $mm^2/s$, of (D-3) was used as the high-viscosity base oil, and the viscosity index was low, so the results were not good.

In Reference Example 7, that which had a 100° C. kinematic viscosity that was low, at 32.7 $mm^2/s$, of the mineral oil (Group 1) of (D-6) was used as the high-viscosity base oil, and the viscosity index was low, and the 0° C. kinematic viscosity also did not pass, so the results were not good.

In Reference Example 8, the GTL low-viscosity base oil of the low-viscosity base oil (A-1), and the viscosity index improving agent and PMA of the additive (E-1) were used, and the 100° C. kinematic viscosity, viscosity index, flashpoint, and 0° C. kinematic viscosity all passed, but the reduction ratio for the 100° C. kinematic viscosity in the KRL shear stability testing was large, at 16.8, so this was concluded to be undesirable.

TABLE 1

Examples 1 to 4

| | Example | | | |
|---|---|---|---|---|
| | 1 | 2 | 3 | 4 |
| Low viscosity base oil; KV100 = between 1 and 2 $mm^2/s$ | | | | |
| A1 | 80.30 | 69.00 | 73.90 | 77.60 |
| A2 | | | | |
| B1 | | | | |
| B2 | | | | |
| Low viscosity base oil; KV100 ≤ 5 $mm^2/s$ | | | | |
| C1 | | | | |
| C2 | | | | |

TABLE 1-continued

Examples 1 to 4

| | Example | | | |
|---|---|---|---|---|
| | 1 | 2 | 3 | 4 |
| High viscosity base oil | | | | |
| D1 | 10.70 | | | |
| D2 | | | | |
| D3 | | 22.00 | | |
| D4 | | | 17.10 | 13.40 |
| D5 | | | | |
| D6 | | | | |
| Additives | | | | |
| E1 | | | | |
| F1 | 9.00 | 9.00 | 9.00 | 9.00 |
| Total | 100.00 | 100.00 | 100.00 | 100.00 |
| Viscosity Index | 207 | 201 | 211 | 197 |
| Kinematic viscosity 40° C. | 19.14 | 19.71 | 18.93 | 15.17 |
| Kinematic viscosity 100° C. | 4.996 | 5.040 | 4.999 | 4.182 |
| Kinematic viscosity 0° C. | 100.6 | 105.0 | 96.2 | 73.7 |
| Flashpoint | 172 | 166 | 170 | 168 |
| KRL Shear Stability (%) | 0.2 | <0.1 | 0.3 | 0.1 |
| NOACK Evaporation (%) | 28.10 | 25.80 | 27.60 | 40.60 |
| Friction co-efficient | 0.043 | 0.036 | 0.041 | 0.043 |
| Rubber Durability Characteristics Tests | | | | |
| Change in hardness | | | −8 | |
| Change in Tensile Strength (%) | | | −65 | |
| Change Elongation at Breaking (%) | | | −45 | |
| Change in Volume (%) | | | 6 | |

TABLE 2

Examples 5 to 8

| | Example | | | |
|---|---|---|---|---|
| | 5 | 6 | 7 | 8 |
| Low viscosity base oil; KV100 = between 1 and 2 $mm^2/s$ | | | | |
| A1 | 41.40 | 46.50 | 76.40 | 53.80 |
| A2 | 30.00 | | | |
| B1 | | | | |
| B2 | | | | |
| Low viscosity base oil; KV100 ≤ 5 $mm^2/s$ | | | | |
| C1 | | 30.00 | | |
| C2 | | | | |
| High viscosity base oil | | | | |
| D1 | | | | |
| D2 | | | 4.60 | |
| D3 | | | | |
| D4 | | | | |
| D5 | 19.60 | 14.50 | 10.00 | 17.20 |
| D6 | | | | |
| Additives | | | | |
| E1 | | | | |
| F1 | 9.00 | 9.00 | 9.00 | 9.00 |
| Total | 100.00 | 100.00 | 100.00 | 100.00 |

TABLE 2-continued

Examples 5 to 8

| | Example | | | |
|---|---|---|---|---|
| | 5 | 6 | 7 | 8 |
| Viscosity Index | 224 | 198 | 210 | 210 |
| Kinematic viscosity 40° C. | 18.22 | 19.70 | 18.99 | 18.94 |
| Kinematic viscosity 100° C. | 4.992 | 5.006 | 4.996 | 4.991 |
| Kinematic viscosity 0° C. | 93.6 | 107.0 | 97.9 | 89.6 |
| Flashpoint | 166 | 184 | 170 | 172 |
| KRL Shear Stability (%) | <0.1 | 0.5 | 0.6 | <0.1 |
| NOACK Evaporation (%) | 41.10 | 19.50 | 28.00 | 28.40 |
| Friction co-efficient | 0.041 | 0.039 | 0.043 | 0.043 |
| Rubber Durability Characteristics Tests | | | | |
| Change in hardness | | | | |
| Change in Tensile Strength (%) | | | | |
| Change Elongation at Breaking (%) | | | | |
| Change in Volume (%) | | | | |

TABLE 3

Reference Examples 1 to 4

| | Reference Example | | | |
|---|---|---|---|---|
| | 1 | 2 | 3 | 4 |
| Low viscosity base oil; KV100 = between 1 and 2 $mm^2/s$ | | | | |
| A1 | | | | |
| A2 | | | | |
| B1 | | | 73.4 | |
| B2 | | | | 67.20 |
| Low viscosity base oil; KV100 ≤ 5 $mm^2/s$ | | | | |
| C1 | 81.20 | | | |
| C2 | | 79.00 | | |
| High viscosity base oil | | | | |
| D1 | | | | |
| D2 | | | | |
| D3 | | | | |
| D4 | | | | |
| D5 | 9.80 | 12.00 | 17.6 | 23.80 |
| D6 | | | | |
| Additives | | | | |
| E1 | | | | |
| F1 | 9.00 | 9.00 | 9.00 | 9.00 |
| Total | 100.00 | 100.00 | 100.00 | 100.00 |
| Viscosity Index | 173 | 182 | 205 | 247 |
| Kinematic viscosity 40° C. | 21.26 | 20.69 | 19.26 | 17.15 |
| Kinematic viscosity 100° C. | 4.997 | 5.012 | 4.999 | 4.984 |
| Kinematic viscosity 0° C. | 128.7 | 122.0 | 100.1 | |
| Flashpoint | 206 | 168 | 172 | 108 |
| KRL Shear Stability (%) | | | | |
| NOACK Evaporation (%) | | | 28.2 | 68.30 |
| Friction co-efficient | | | | |
| Rubber Durability Characteristics Tests | | | | |
| Change in hardness | | | −10 | |
| Change in Tensile Strength (%) | | | −67 | |
| Change Elongation at Breaking (%) | | | −55 | |
| Change in Volume (%) | | | 6 | |

TABLE 4

Reference Examples 5 to 8

| | Reference Example | | | |
|---|---|---|---|---|
| | 5 | 6 | 7 | 8 |
| Low viscosity base oil; KV100 = between 1 and 2 $mm^2/s$ | | | | |
| A1 | 65.60 | 62.20 | 55.10 | 80.00 |
| A2 | | | | |
| B1 | | | | |
| B2 | | | | |
| Low viscosity base oil; KV100 ≤ 5 $mm^2/s$ | | | | |
| C1 | | | | |
| C2 | | | | |
| High viscosity base oil | | | | |
| D1 | 25.40 | | | |
| D2 | | | | |
| D3 | | 28.80 | | |
| D4 | | | | |
| D5 | | | | |
| D6 | | | 35.90 | |
| Additives | | | | |
| E1 | | | | 11.00 |
| F1 | 9.00 | 9.00 | 9.00 | 9.00 |
| Total | 100.00 | 100.00 | 100.00 | 100.00 |
| Viscosity Index | 180 | 187 | 145 | 295 |
| Kinematic viscosity 40° C. | 20.74 | 20.35 | 23.70 | 15.47 |
| Kinematic viscosity 100° C. | 4.998 | 5.007 | 5.031 | 5.000 |
| Kinematic viscosity 0° C. | 123.7 | 112.4 | 164.7 | 62.0 |
| Flashpoint | 180 | 172 | 174 | 168 |
| KRL Shear Stability (%) | | | | 16.8 |
| NOACK Evaporation (%) | | | | |
| Friction co-efficient | | | | |
| Rubber Durability Characteristics Tests | | | | |
| Change in hardness | | | | |
| Change in Tensile Strength (%) | | | | |
| Change Elongation at Breaking (%) | | | | |
| Change in Volume (%) | | | | |

That which is claimed is:

1. A lubricating oil composition for an automatic transmission, the lubricating oil composition comprising (a) a first low viscosity oil base oil at a concentration of between 45% and 95% by mass, wherein the low viscosity base oil comprises a Fischer-Tropsch synthetic low-viscosity base oil, and wherein the low viscosity base oil has a kinematic viscosity of between 1 $mm^2/s$ and 2 $mm^2/s$ at 100° C., (b) a second low viscosity base oil at a concentration of between 0% and 25% by mass, wherein the second low viscosity base oil is not a Fischer-Tropsch synthetic low-viscosity base oil, and wherein the second low viscosity base oil has a kinematic viscosity of between 1 $mm^2/s$ and 2 $mm^2/s$ at 100° C., (c) a base oil at a concentration of between 0% and 35% by mass, wherein the base oil has a kinematic viscosity of between 2 $mm^2/s$ and 5 $mm^2/s$ at 100° C., and (d) a high viscosity base oil at a concentration of between 5% and 55% by mass, wherein the high viscosity base oil comprises one of an olefin polymer and a co-polymer, and wherein the high viscosity base oil has a kinematic viscosity of between 100 $mm^2/s$ and 800 $mm^2/s$ at 100° C., wherein the lubricating oil composition has:

a kinematic viscosity of between 3.8 $mm^2/s$ and 5.5 $mm^2/s$;

a viscosity index is no less than 190;

a flashpoint of equal to or greater than 140° C., and a rate of reduction in a 100° C. kinematic viscosity of not more than 3%, as measured after a KRL shear stability test having been performed at 60° C. for 20 hours.

2. The lubricating oil composition according to claim 1, wherein the high-viscosity base oil has a 100° C. kinematic viscosity of between 200 $mm^2/s$ and 700 $mm^2/s$.

3. The lubricating oil composition according to claim 1, wherein the lubricating oil composition a kinematic viscosity of between 4.5 $mm^2/s$ and 5.2 $mm^2/s$.

4. The lubricating oil composition according to claim 1, wherein the lubricating oil composition has a flashpoint equal to or greater than 160° C.

5. The lubricating oil composition according to claim 1, wherein the lubricating oil composition has a 0° C. kinematic viscosity of less than or equal to 120 $mm^2/s$.

6. The lubricating oil composition according to claim 1, wherein the lubricating oil composition has a Noack evaporation loss of not more than 50 wt %.

7. The lubricating oil composition according to claim 1, wherein the low viscosity base oil has a kinematic viscosity of between 1.2 $mm^2/s$ and 1.8 $mm^2/s$ at 100° C.

8. The lubricating oil composition according to claim 1, wherein the lubricating oil composition further comprises one or more of an extreme pressure agent, a dispersing agent, a metal-based cleaning agent, a friction adjusting agent, an oxidation inhibitor, a corrosion inhibitor, a rust inhibitor, an anti-emulsifying agent, a metal deactivating agent, a pour point depressing agent, a seal swelling agent, an anti-foaming agent, and a coloring agent.

9. The lubricating oil composition according to claim 1, wherein the lubricating oil composition has the rate of reduction in the 100° C. kinematic viscosity of not more than 1%, as measured after the KRL shear stability test having been performed at 60° C. for 20 hours.

10. The lubricating oil composition according to claim 1, wherein the co-polymer is an ethylene-alpha olefin copolymer.

11. The lubricating oil composition according to claim 1, wherein the base oil comprises one of a group 2 base oil, a group 3 base oil, and a group 4 base oil, as classified by the American Petroleum Institute base oil classifications.

12. The lubricating oil composition according to claim 1, wherein the sulfur content of each of the first low viscosity base oil and the second low viscosity base oil is less than 1 ppm.

* * * * *